US006213033B1

(12) United States Patent
Manelis et al.

(10) Patent No.: US 6,213,033 B1
(45) Date of Patent: Apr. 10, 2001

(54) METHOD FOR TREATING WASTE MATERIAL CONTAINING HYDROCARBONS

(75) Inventors: Georgi Manelis; Victor Foursov; Galina Yakovleva; Sergei Glazov; Lev Stesik; Evgeni Poliantchik, all of Chernogolovka; Nikolai Alkov, Moscow, all of (RU)

(73) Assignee: Fioter Oy, Ylamma (FI)

( * ) Notice: Subject to any disclaimer, the term of this patent is extended or adjusted under 35 U.S.C. 154(b) by 0 days.

(21) Appl. No.: 09/242,953

(22) PCT Filed: Sep. 2, 1996

(86) PCT No.: PCT/FI96/00466

§ 371 Date: Apr. 21, 1999

§ 102(e) Date: Apr. 21, 1999

(87) PCT Pub. No.: WO98/10224

PCT Pub. Date: Mar. 12, 1998

(51) Int. Cl.[7] ..... F23G 5/12; F23G 5/00

(52) U.S. Cl. ..... 110/346; 110/344; 110/229; 110/234; 110/244; 110/245

(58) Field of Search ..... 110/344, 346, 110/229, 234, 244, 245; 422/149; 48/198.2, 203, 197 A

(56) References Cited

U.S. PATENT DOCUMENTS

| | | | | |
|---|---|---|---|---|
| 2,557,680 | * | 6/1951 | Odell | 202/14 |
| 3,411,465 | * | 11/1968 | Takashi | 110/8 |
| 3,868,331 | * | 2/1975 | Van Lookern Campagne | 252/373 |
| 3,894,497 | * | 7/1975 | Helke et al. | 110/8 R |
| 4,023,280 | * | 5/1977 | Schora et al. | 34/10 |
| 4,387,653 | * | 6/1983 | Voss | 110/342 |
| 4,565,139 | * | 1/1986 | Sage et al. | 110/347 |
| 4,931,161 | | 6/1990 | Sundar . | |
| 4,957,048 | * | 9/1990 | Beer et al. | 110/235 |
| 4,960,057 | * | 10/1990 | Oshita et al. | 110/345 |
| 4,967,673 | * | 11/1990 | Gunn | 110/346 |
| 5,101,742 | * | 4/1992 | Sowrds et al. | 110/245 |
| 5,257,587 | | 11/1993 | Ohlsen et al. . | |
| 5,435,890 | * | 7/1995 | Munger | 202/93 |
| 5,725,614 | * | 3/1998 | Hirayama et al. | 48/76 |

FOREIGN PATENT DOCUMENTS

| | | |
|---|---|---|
| 51-33486 | 11/1973 | (JP) . |
| 1090972 | 5/1984 | (RU) . |

* cited by examiner

*Primary Examiner*—Denise L. Ferensic
*Assistant Examiner*—K. B. Rinehart
(74) *Attorney, Agent, or Firm*—Altera Law Group LLC

(57) ABSTRACT

The present invention relates to a method for treating water material containing hydrocarbon, wherein the waste material is supplied in a reactor, gas containing oxygen is supplied in the reactor, said substances are combusted to form gaseous combustion products and solid residue and said solid residue is discharged from the reactor. The gas containing oxygen is supplied continuously in the reactor in amounts insufficient for complete oxidation of the waste material, said gas containing oxygen is supplied so as to pass it through a layer of said solid residue and the gaseous combustion products are passed through a layer of untreated waste material to form a product gas containing hydrocarbons and droplets of liquid hydrocarbons.

18 Claims, 2 Drawing Sheets

METHOD FOR TREATING WASTE MATERIAL CONTAINING HYDROCARBONS

Figure 1:
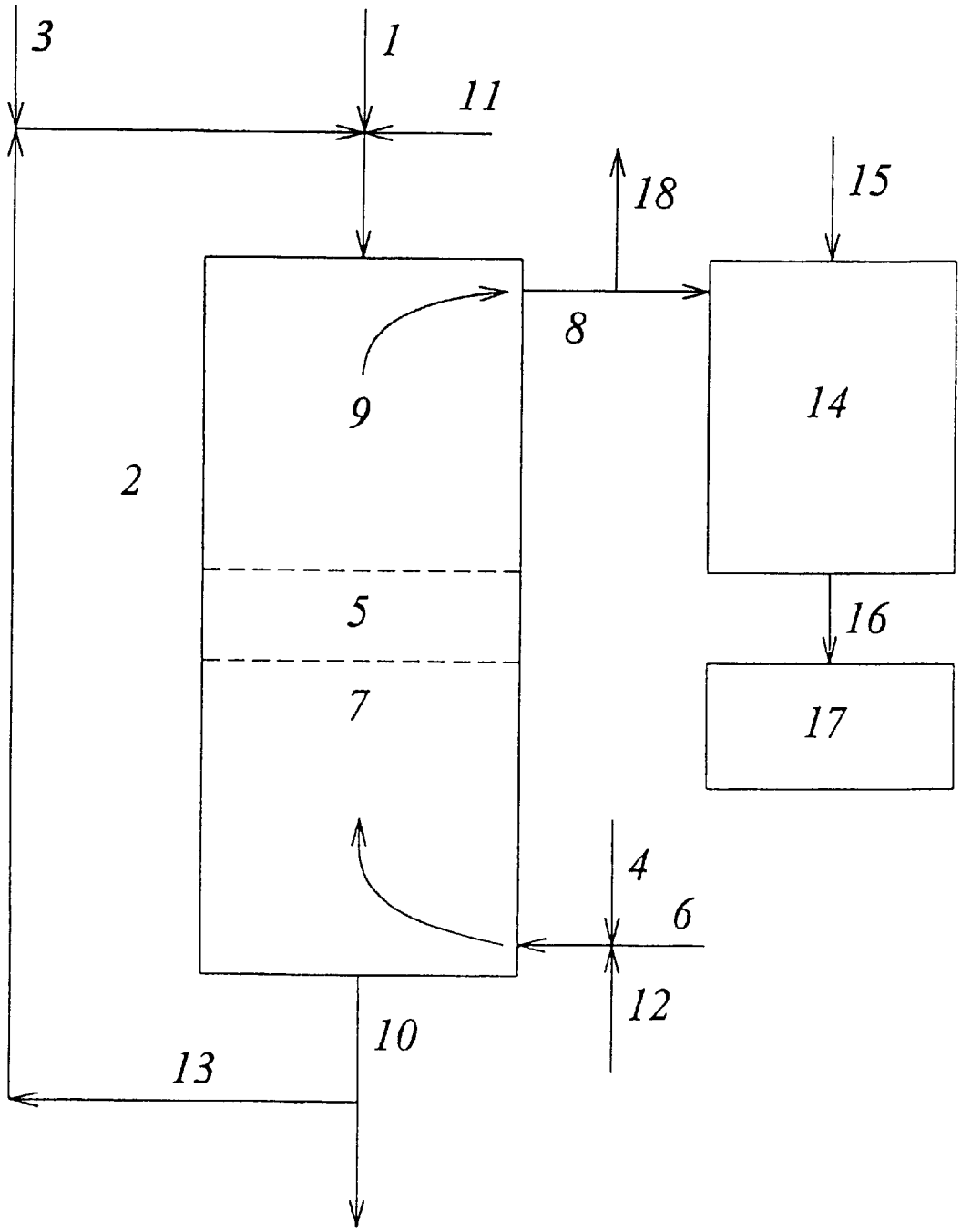

The present invention relates to a method for treating waste material containing hydrocarbons, wherein said material is supplied to a reactor, gas containing oxygen is supplied to the reactor, said substances are combusted to form solid residue and said solid residue is discharged from the reactor.

In this disclosure waste material containing hydrocarbons means any kind of material containing hydrocarbons (with longer or shorter carbon chain), found in the nature, produced chemically, formed in mineral or mechanical processes, formed through leakings of materials containing hydrocarbon into soil, etc. Especially, the method is directed to treating waste materials, ie. sludges containing heavy liquid and/or solid hydrocarbons, solid incombustible materials, water, etc. Further, the invention provides a method for treating industrial waste materials obtained in thermal treatment of metals and comprising oils, possibly partially oxidized or carbonized, ferrous oxides, and other admixtures; crude oil spills, mixed with solid impurities; slurries and sludges, such as sediments of oil tanks, bituminous sands, etc. Hereafter all such materials are referred to as waste materials.

Waste materials are difficult to process for disposal purposes. The disposal of waste materials through environmentally acceptable incineration, recovering the energy content and recovering their hydrocarbon contents in a processible form by conventional techniques is problematic. Direct incineration of waste materials is usually hampered by their high viscosity and the presence of solids therein, which prevent the application of conventional incineration methods, such as atomization in fuel jets. Isolation of hydrocarbons by distillation is generally energy consuming.

From patent specification JP 51-33486 a method is known for disposal of oxides containing oil by adding them to an agglomeration mixture with further thermal treatment in a rotary kiln. The hydrocarbons are burnt in the process, yielding additional heat, and the iron oxides enter the mixture. This method has relatively narrow applicability, only in some metallurgical processes, and relatively high energy costs if it is used in oil incineration.

From patent specification RU 1090972 a method is known for disposal of wastes containing oil and iron. In this method, liquid waste oils are dehydrated until the fuel contents of 30–95% is attained and are further burnt at a relatively substoichiometric air (0.35–0.65 of stoichiometric oxygen). At the smoke temperature of 950–1100° C., the dehydrated waste is treated with the gaseous combustion products and, after reduction of metal oxides, the gaseous products are afterburnt, the heat of smoke gases being used for dehydration of the waste. The main disadvantage of this method is the stage of water evaporation, which hampers environmental safety of the process and makes the method complicated. Further, the method has a narrow field of economical application.

From the patent specification U.S. Pat. No. 4,957,048 a method is known, wherein crude oil slurries and other slurries containing heavy hydrocarbons are incinerated. The slurries are mixed with diatomite or perlite so as to obtain a friable mass that is further applied to an incinerator type of rotary kiln or a fluidized bed tubular furnace where the mixture is burnt to yield smoke gases and solid residue that is virtually free of hydrocarbons. The solid residue can be recycled for mixing with fresh oil slurries. This method has a number of disadvantages. The use of conventional rotary kilns is associated with high energy expenditure. Apart from that, due to the entrainment of particulates in flue gas flow, the system requires a complicated secondary cleansing for smoke gases involving cyclones and/or scrubbers. Another disadvantage of the rotary kiln embodiment is caused by the unburnt carbon present in solid residues. The latter must be afterburnt in a fluidized bed furnace. When fluidized bed reactors are used, the method is sensitive to the size of particulates, both initially contained in waste oil and added in preparing the mixture.

An object of the present invention is to eliminate the drawbacks of the prior art.

Another object of the present invention is to provide an environmentally safe and energy-efficient method for treating a variety of waste materials containing hydrocarbons.

Another object of the present invention is to provide a method for treating waste material containing hydrocarbons, wherein at least a part of the hydrocarbons may be recovered.

Regarding the features characterizing the invention, reference is made to the claims section.

According to the invention gas or gasifying agent containing oxygen is supplied continuously in the reactor in amounts insufficient for complete oxidation of the waste material, said gas or gasifying agent containing oxygen is supplied so as to pass it through a layer of said solid residue and the gaseous combustion products are passed through a layer of untreated waste material to form a product gas containing hydrocarbons and droplets of liquid hydrocarbons. Accordingly the product gas comprises gaseous combustion products of hydrocarbons. Because of the substoichiometric amount of oxygen, the combustion products comprise carbon monoxide and hydrogen in addition to carbon dioxide and water.

According to an advantageous embodiment, the gas containing oxygen is supplied to the reactor countercurrently to the supply of the waste material so that the combustion zone is formed.

Accordingly, the combustion zone is formed in the middle part of the reactor, that means between the ends of the reactor. The gas or gasifying agent containing oxygen is supplied to the reactor at a point after the combustion zone in the streaming direction and the gaseous products are discharged from a point before the combustion zone in the streaming direction of the waste material.

To enhance the yield of hydrocarbons, in order to promote their evaporation, one can introduce steam into the zone where hydrocarbons are heated by the hot product gas.

Figure 2:
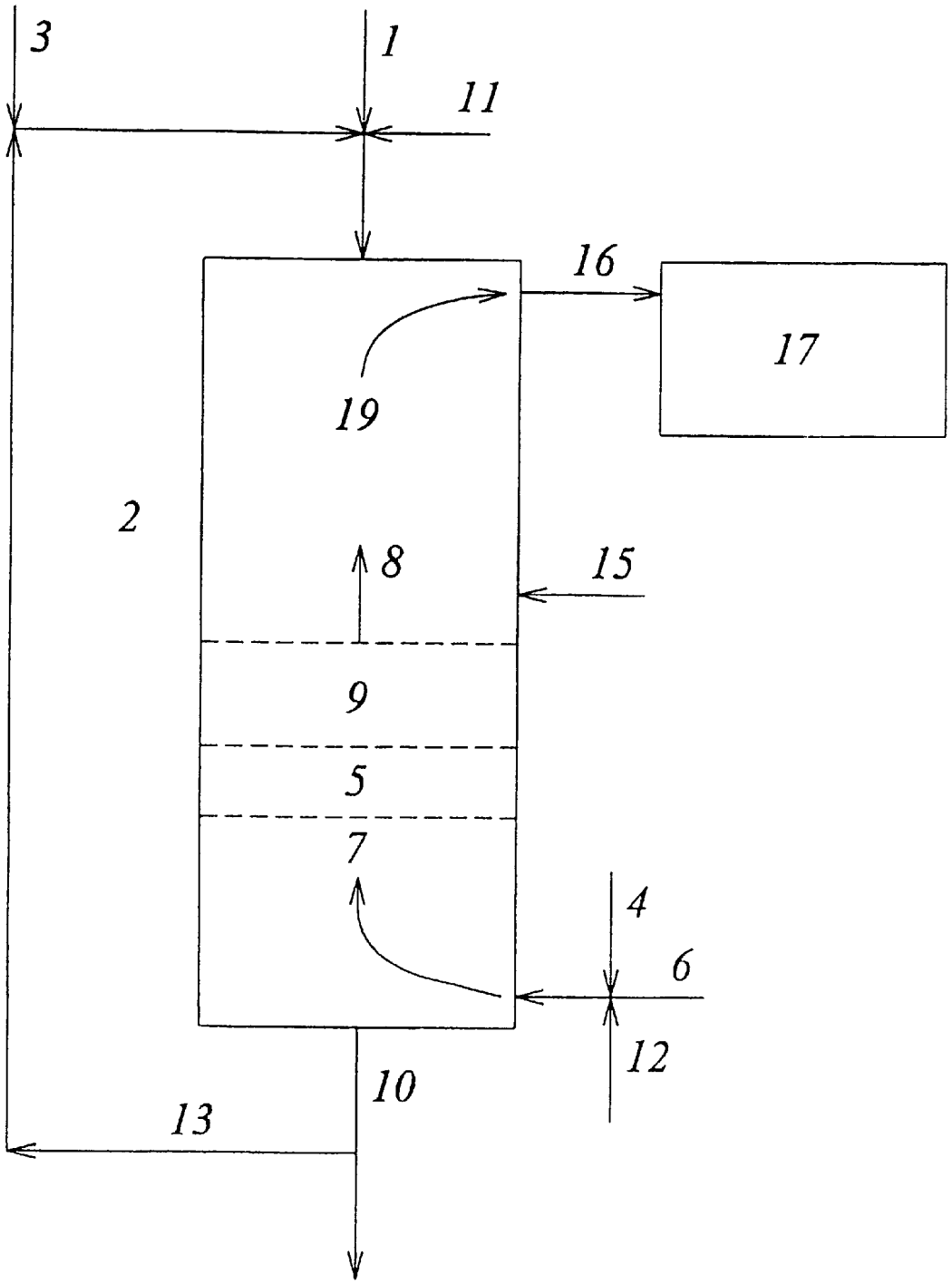

In the following, the invention is disclosed with nonrestricting examples referring to FIGS. 1 and 2 showing schematical flow charts of two embodiment examples, and with Examples 1 and 2.

For implementing the treating process the waste material charged into the reactor 2 is preferably sufficiently gas-permeable. The reactor may e a vertical reactor, in particular a shaft kiln. If the waste material 1 contain enough solid particles of sufficiently large dimension, the waste material 1 can be treated as it is. When the contents of solids of the waste material is low or particle size is too small (so as to hamper gas permeability), the waste material 1 may preferably be, prior to charging into the reactor, be mixed with solid incombustible material 3 that has a melting point high enough to avoid agglomeration; the solid material may be e.g. firebrick pieces. Alternatively, the solid inert material may be charged into the reactor without preliminary mixing with the waste material (e.g., in intermittent layers) if this mode of charging secures sufficient gas permeability and homogeneity on the average of the charge. To secure high gas permeability, the inert material having predominantly pieces size over 20 mm may be used. The experiments carried out have shown that with this size of particles the pressure drop in the charge at the gas flow rate of 1000 $m^3$/h of per 1 $m^2$ reactor cross-section did not exceed 500 Pa/m. This makes is possible to perform a process at low pressure drop in the reactor, this drop may be provided with a fan and not a compressor. Pieces of waste refractory or some special items such as tubular cylinders may be used, as this inert material.

The process may be initiated by injecting into the reactor gas or gasifying agent containing oxygen, preliminarily heated to a temperature over 400° C. The preheated gasifying agent may be supplied during a time sufficient to establish in the reactor the zone of gasification. This zone establishes a result of ignition of the changed waste material in a section of the reactor adjacent the gasifying agent inlet. As a result, a processing zone established in the reactor. In this zone, as the charge heats up, the following processes occur successively. Light hydrocarbons condense forming suspended fine droplets of oil, lighter fractions of the waste oil material evaporate, heavier fractions of waste oil material pyrolyze yielding char, the char and possibly a part of heavy organics burn.

The combustion zone moves with respect to the charge. When a stationary processing zone established in the reactor, the preheating of the gasifying agent 6 is redundant and cool gasifying agent is supplied to the reactor substoichiometrically, in the amount insufficient for complete oxidation of organics; the gasifying agent being supplied so as to pass it through a layer 7 of hot solid residue free of carbon and hydrocarbons formed as the processing zone 5 propagates over the charge. The product gas formed in the processing zone 5, which bears fine droplets of condensed hydrocarbons (and possibly water) generally contains carbon mono- and dioxide, nitrogen, hydrogen, hydrocarbon gases, etc. the product gas is directed through a layer 9 of an unprocessed waste material and withdrawn or discharged from the reactor.

The process described can be performed either in a continuous mode or in batches. In the first case the waste material (processing mixture) is supplied to the reactor continuously or in portions and the solid residue of the process is discharged from the reactor continuously or in portions. In the second case, the reactor is recharged after the charge was processed and the reactor extinguished. In the first case, the processing zone remains on average stationary with respect to the reactor, although it propagates with respect to countercurrently moving charge. In the second case, the processing zone moves along the stationary charge with respect to the reactor.

The processing in the system when the gasifying agent 6 and then the product gas 8 successively passes through the solid residue of the process 10 and the solid charge, respectively, owing to interface heat exchange, provides a possibility to substantially reduce both the temperature of the product gas and that of the solid residue. This provides a possibility to accumulate heat in the zone where the combustion occurs and secures complete burning of the char. Apart from that, unlike in the prior art, the filtration of the product gas through fresh oil prevents entrainment of particulates in the gas flow; this dramatically simplifies further cleansing of smoke gases. Another advantage over the prior art is that this method, once initiated, is self-sustained with the heat of the combustion and does not require any additional energy supply. However, when waste material or oils containing extremely little of non-volatile organic matter is to be processed, one may use the present method by intentionally adding some solid fuel 11 (e.g. up to 10% by weight) to the charge. Such a solid fuel can be any one of organic containing carbon, in particular, wood, textile, pulp waste, peat or coal fines, etc.

The present method, since it is distinguished by the accumulation of the combustion heat in the processing zone (the heat is stored by the heated solid residue) is stable with respect to fluctuations in flow rates, inhomogeneities of the charge and variations of composition of the gasifying agent. Even after a complete shutoff of supply of the gasifying agent, the process may be relit by simple resumption of the supply during the time when the temperature of the charge remains high.

By varying the ratio of the mass of the components of the charge that burn in the combustion zone (contained in the oil and intentionally introduced) to the mass of solid residue, one can widely control the temperature of the combustion zone and the width of the latter. Possible variations are high indeed. Thus experiments on a model composition comprising lubricating oil, coal dust, and pieces of firebrick (26:3:71 by weight) with air used as a gasifying agent, showed that gasification and afterburning of the product gas proceed steadily without any external heat source; the maximum combustion temperature amounted to 1100° C. Only at the contents of carbonized fuel lower than 0.02 of the solid residue, the process grows unstable. In the latter case, the temperature in the processing zone decreases after ignition and the process extinguishes. An increase in the above ratio until a certain ratio that depends on the particular composition of waste oil results in higher temperature in the combustion zone and enhanced width of the latter. Over this limit the combustion temperature decreases in spite of higher concentration of the solid fuel. This reduction is due to lower accumulation of heat by the solids in the processing zone.

When processing waste oils with a high content of heavy fractions (high yield of char) one can, in order to reduce the maximum temperature of combustion and improve the calorific value of the product gas, introduce water in the gasifying agent so as to relay heat effect of combustion to the product gas owing to water gas reactions.

The solid residues of the process that pass through the combustion zone are substantially free of hydrocarbons, char, and organics. In most cases, they can be easily disposed of. In particular, the processing of waste oils of metallurgy may yield useful products, such as ferrous oxides that might be used. The solid residue or its part, possibly after elimination of fines, may be reused for making the mixture to be charged into the reactor.

The product gas may be easily and environmentally friendly disposed of using known techniques. In particular, it may be burnt in an afterburner, whereinto secondary air 15 sufficient for complete oxidation of hydrocarbons is injected. Small size of the hydrocarbon droplets secures fast, complete, and clean combustion thereof. The heat released in aftercombustion may be used, e.g. by directing smoke gases 16 to boiler 17.

In some cases it is economical to direct, prior to afterburning, the product gas into a condenser, wherein at least a part of the condensable hydrocarbons 18, which are substantially free of solids and are typically composed of lighter fractions than the initial oil, may be recovered and directed for use according to conventional techniques.

FIG. 2 schematically presents an embodiment example of the method in the case when the hydrocarbons produced have no other value but for their heat contents. In this example a secondary combustion is performed in the reactor 2, in a part of its volume 19 that is substantially free of processing mixture and wherein the secondary air 15 for complete burning of the product gas is injected.

EXAMPLE

In laboratory experiments the materials presented in the table 1 were mixed with firebrick pieces size of 20 to 50 mm (1–3, 5 or 7–10 mm (4, 6) and solid fuel in quantities shown in the table.

TABLE 1

| | Matter | HC, %/w | ASH, %/w | HUM, %/w | ADF, %/w | I, %/w | STM, %/w | HCR, %/w | PR, m/h |
|---|---|---|---|---|---|---|---|---|---|
| 1 | IND | 80 | 10 | 10 | — | 79 | 2+ | . . .* | 1.7 |
| 2 | IND | 80 | 10 | 10 | — | 79 | 30 | 50 | 1.9 |
| 3 | LBR | 95 | 2 | 3 | 10** | 65 | 0 | 70 | 1.6 |
| 4 | SED | 60 | 30 | 10 | 8*** | 67 | 20 | 63 | 2.3 |
| 5 | SOIL | 18 | 36 | 46 | 8** | 67 | 2+ | . . .* | 2.1 |
| 6 | BTS | 16 | 80 | 4 | 7** | 40 | 20 | 47 | 1.5 |
| 7 | ASP | 19 | 79 | 2 | — | — | 20 | . . .* | 1.2 |

+natural air humidity
*product gas was afterburnt directly
**coal fines
***sawdust In the table 1, IND is spent industrial oil of thermal treatment, LBR is spent lubricant oil, SED is sediment from a black oil tank, SOIL is soil contaminated with crude oil and lubricant oils spill, BTS is bituminous sand and ASP is asphalt.

HC is hydrocarbons content in material, ASH is ash content, HUM is humidity; ADF is the quantity of solid fuel added to the processing mixture, I is the fraction of solid inert material added to the mixture, STM is the fraction of steam in gasifying agent; HCR is the fraction of hydrocarbons recovered in the form of liquid oil, and PR is linear processing rate of the fresh processing mixture in the reactor (i.e., the linear rate of propagation of the gasification zone along the processing mixture).

The prepared mixtures were charged into a cylindrical reactor. The ignition was achieved by means of injecting into the reactor hot (400–450° C.) air for several minutes. In the course of the established process, air at room temperature or 100° C. air-steam mixture was supplied to the reactor. After the process was initiated, the process proceeded with intense formation of the product gas bearing extremely fine (about 1 $\mu$m) oil droplets and containing nitrogen, carbon di- and monoxide, hydrogen, and uncondensable hydrocarbons. In certain cases, a fraction of liquid hydrocarbons was condensed in a winding tube to yield liquid oil (collected together with water, with which the oil readily stratified). In all the cases mentioned, the temperature in the processing zone exceeded 800° C. (the maximum value was 1250° C.). The product gas burned steadily with the supply of secondary air in the afterburner. The smoke gases die not contain (within 100 ppm) nitrogen oxides and carbon monoxide. Neither soot nor dust particles were detected in the smoke gases. The solid residue discharged from the reactor was free of char and hydrocarbons. After fractionating it, the firebrick pieces recovered were repeatedly employed for preparation of the mixture.

What is claimed is:

1. A method for treating waste material containing hydrocarbons and solid incombustibles, comprising supplying the waste material in a reactor;

supplying gas containing oxygen continuously to the reactor in amounts insufficient for complete oxidation of the waste material;

combusting the waste material and gas containing oxygen to form gaseous combustion products and solid residue;

discharging the solid residue from the reactor;

withdrawing the gaseous combustion products so as to form a zone of untreated waste material, a zone of solid residue and a zone of combustion with the zone of combustion between the zones of untreated waste material and of solid residue;

wherein the solid incombustibles comprise substantially solid pieces having a mesh size in excess of 20 mm, the gas containing oxygen is supplied to the reactor countercurrently with the supply of waste material so that the gas containing oxygen flows through the zone of solid residue, the zone of combustion and then the zone of untreated waste material to form a product gas containing hydrocarbons and droplets of liquid hydrocarbons, the solid residue being substantially cooled by the gas flow of the gas containing oxygen prior to discharging the residue from the reactor.

2. A method for treating waste material containing hydrocarbons and solid incombustibles, comprising:

adding solid incombustible matter to the waste material, the solid incombustible matter including solid pieces having a size in excess of 20 mm;

supplying the water material in a reactor;

supplying gas containing oxygen continuously to the reactor in amounts insufficient for complete oxidation of the waste material;

combusting the waste material and gas containing oxygen to form gaseous combustion products and solid residue;

discharging the solid residue from the reactor;

withdrawing the gaseous combustion products so as to form a zone of untreated waste material, a zone of solid residue and a zone of combustion with the zone of combustion between the zones of untreated waste material and of solid residue;

wherein the solid incombustible matter added to the waste material comprise substantially solid pieces having a mesh size in excess of 20 mm, the gas containing oxygen is supplied to the reactor countercurrently with the supply of waste material so that the gas containing oxygen flows through the zone of solid residue, the zone of combustion and then the zone of untreated waste material to form a product gas containing hydrocarbons and droplets of liquid hydrocarbons, the solid residue being substantially cooled by the gas flow of the gas containing oxygen prior to discharging the residue from the reactor.

3. A method according to claim 2, further comprising mixing the waste material and the incombustible matter prior to supplying the waste material to the reactor.

4. A method according to claim 2, wherein the incombustible matter is one of refractory material and waste refractory material.

5. A method according to claim 2, wherein the incombustible matter includes solid residue removed from the reactor.

6. A method according to claim 1, further comprising adding solid fuel to the reactor in an amount of less than 10% by weight of materials supplied to the reactor.

7. A method according to claim 1, further comprising controlling a maximum temperature and width of the combustion zone by varying a mass ratio of carbonized combustibles of the waste burning within the combustion zone to the solid incombustibles of the waste material, the mass ratio being in excess of 0.02.

8. A method according to claim 1, wherein the reactor is a vertical reactor and a direction of gas flow is parallel to a vertical axis of the reactor.

9. A method according to claim 1, further comprising supplying the waste material to the reactor and discharging the solid residue from the reactor in batches.

10. A method according to claim 1, further comprising supplying the waste material to the reactor and discharging the solid residue from the reactor continuously.

11. A method according to claim 1, further comprising supplying water to the reactor.

12. A method according to claim 1, further comprising supplying steam to the reactor along with the gas containing oxygen.

13. A method according to claim 1, further comprising recovering condensable hydrocarbons from the product gas.

14. A method according to claim 1, further comprising afterburning the product gas outside the reactor whereby hydrocarbons and combustible gases in the produce gas are completely oxidized.

15. A method according to claim 1, further comprising injecting the gas containing oxygen pre-heated to a temperature exceeding 400° C. into the reactor during start-up to ignite the waste material.

16. A method according to claim 2, further comprising adding solid fuel to the reactor in an amount of less than 10% by weight of materials supplied to the reactor.

17. A method according to claim 2, further comprising controlling a maximum temperature and width of the combustion zone by varying a mass ratio of carbonized combustibles of the waste burning within the combustion zone to the solid incombustibles of the waste material, the mass ratio being in excess of 0.02.

18. A method according to claim 2, further comprising injecting the gas containing oxygen pre-heated to a temperature exceeding 400° C. into the reactor during start-up to ignite the waste material.

* * * * *